US011852380B2

(12) United States Patent
Lesage et al.

(10) Patent No.: US 11,852,380 B2
(45) Date of Patent: Dec. 26, 2023

(54) RETROFIT COVER PLATE AND ASSEMBLY TO ADAPT ALTERNATIVE ENERGY SUPPLIES TO ELECTRIC WATER HEATERS

(71) Applicants: Claude Lesage, Pointe Claire (CA); Guy Jean Houle, Blainville (CA)

(72) Inventors: Claude Lesage, Pointe Claire (CA); Guy Jean Houle, Blainville (CA)

(73) Assignee: GIANT FACTORIES INC., Montreal East (CA)

( * ) Notice: Subject to any disclaimer, the term of this patent is extended or adjusted under 35 U.S.C. 154(b) by 310 days.

(21) Appl. No.: 16/974,303

(22) Filed: Dec. 21, 2020

(65) Prior Publication Data

US 2022/0196286 A1 Jun. 23, 2022

(51) Int. Cl.
*F24H 9/02* (2006.01)
*F24H 9/20* (2022.01)
(Continued)

(52) U.S. Cl.
CPC ..... *F24H 9/02* (2013.01); *F24H 1/185* (2013.01); *F24H 1/202* (2013.01); *F24H 1/208* (2013.01);
(Continued)

(58) Field of Classification Search
CPC . F24H 9/02; F24H 9/133; F24H 1/185; F24H 1/202; F24H 9/1818; F24H 9/2021;
(Continued)

(56) References Cited

U.S. PATENT DOCUMENTS 2,686,031 A * 8/1954 Bolesky ..... H01H 37/04 248/300
4,543,445 A * 9/1985 Turner ..... H02B 1/06 392/449

(Continued)

FOREIGN PATENT DOCUMENTS

WO WO-9529368 A1 * 11/1995 ..... F24H 9/20

*Primary Examiner* — Michael G Hoang
*Assistant Examiner* — Kurt J Wolford
(74) *Attorney, Agent, or Firm* — . J. Houle; HOULE PATENT AGENCY INC.

(57) ABSTRACT

A multi-functional retrofit cover plate assembly and method for an electric water heater to provide interconnection with an alternative energy system to heat water in a water holding tank of the electric water heater. The cover plate is adapted for replacement connection over a bottom access opening formed in an outer casing of the electric water heater which permits access to a bottom resistive heating element and electrical connections. The retrofit cover plate is shaped to define an internal dedicated compartment. A dual resistive heating element is provided for replacement of the bottom resistive heating element. An electronic switch unit is further provided and it has a power cut-off switch for connection to an alternative supply voltage. A temperature sensor is provided for mounting against an outer surface of the tank of the water heater to feed actual temperature signals of water temperature within the tank, in a lower region thereof, to the electronic switch unit which operates the power cut-off switch upon a predetermined temperature having been attained in the tank of the water heater. The retrofit cover plate and the assembly also make it possible to covert the water heater to a high temperature water heater or to adapt the electric water heater to a thermal fluid heat source.

28 Claims, 12 Drawing Sheets

(51) Int. Cl.
*F24H 1/18* (2022.01)
*F24H 9/13* (2022.01)
*F24H 9/1818* (2022.01)
*F24H 1/20* (2022.01)

(52) U.S. Cl.
CPC ..... *F24H 9/133* (2022.01); *F24H 9/1818* (2013.01); *F24H 9/2021* (2013.01); *F24H 1/182* (2013.01); *F24H 2240/01* (2013.01); *F24H 2240/09* (2013.01)

(58) Field of Classification Search
CPC ... F24H 1/182; F24H 2240/01; F24H 2240/09
USPC ..... 392/441
See application file for complete search history.

(56) References Cited

U.S. PATENT DOCUMENTS 4,872,443 A * 10/1989 Ruark ..... F24H 1/205 49/463
5,163,119 A * 11/1992 Windon ..... F24H 1/182 264/46.7
5,293,447 A * 3/1994 Fanney ..... G05F 1/67 219/508
5,293,844 A * 3/1994 Threatt ..... F24H 1/182 122/494
5,660,165 A * 8/1997 Lannes ..... F28D 7/024 122/18.31
6,658,204 B2 * 12/2003 Schurter ..... F24H 9/2021 392/441
7,162,150 B1 * 1/2007 Welch ..... F24H 9/1818 392/455
7,189,922 B1 * 3/2007 Rose ..... H01R 13/5213 174/67
8,498,527 B2 * 7/2013 Roetker ..... F24H 1/202 392/441
9,395,101 B2 * 7/2016 Lesage ..... F24H 9/2021
9,933,184 B2 * 4/2018 Lesage ..... H05B 3/04
10,066,851 B2 * 9/2018 Kreutzman ..... F24H 1/0027
2003/0194227 A1 * 10/2003 Schurter ..... F24H 1/182 392/441
2007/0248340 A1 * 10/2007 Phillips ..... F24H 9/2014 392/441
2008/0066308 A1 * 3/2008 Syler ..... F24H 1/182 122/13.01
2010/0004790 A1 * 1/2010 Harbin, III ..... F24D 19/1051 709/219
2014/0112647 A1 * 4/2014 Lichtenberger ..... F24H 1/202 392/441
2014/0153913 A1 * 6/2014 Newman ..... F24H 1/202 392/500
2014/0348493 A1 * 11/2014 Kreutzman ..... F24H 1/0027 392/441
2016/0138830 A1 * 5/2016 Lesage ..... G05D 23/1934 219/486
2016/0195284 A1 * 7/2016 Chaudhry ..... F24D 19/1057 219/494

* cited by examiner

RETROFIT COVER PLATE AND ASSEMBLY TO ADAPT ALTERNATIVE ENERGY SUPPLIES TO ELECTRIC WATER HEATERS

TECHNICAL FIELD

The present invention relates to a multi-functional cover plate and an associated assembly of components to adapt electric water heaters to alternative electrical energy systems or thermal energy systems to heat water in its water storage tank. Examples of such alternative energy systems are solar systems using photovoltaic (PV) panels to produce electrical energy from the sun, or wind generators which harness energy from the wind to produce electrical power or recuperated thermal energy from heat exchange fluids from heat pumps or other heat exchange devices.

BACKGROUND OF THE INVENTION

Due to an increasing demand for electrical energy, as well as the increasing cost thereof, attention has been directed to the development of alternative energy systems to produce electrical power. Particular attention has been given to the development of wind turbines and photovoltaic solar panels which harness energy from the wind and sun and convert such energy to electrical voltage to supply electrical devices. It is known that electric water heaters consume a great amount of electrical power when there is a need to heat water in its tank and this is accomplished by powering two or more resistive heating elements consuming in the range of about 4,000 to 9,000 watts of power when energized. Some grid providers have developed control systems in an attempt to regulate the increasing demand from the grid by appliances such as water heaters, particularly during peak periods where electricity is in an increase demand or when restoring power after a power failure on the grid. One solution to reduce this problem is to use alternative energy sources which generate electrical power to heat water in the tanks of electrical water heaters when power is available, and when conditions inside the tank permit it to do so, whereby to raise the temperature of water within the tank to reduce the consumption of electrical energy from the grid.

Reference is made to U.S. Pat. Nos. 9,885,498 and 10,151,510 wherein there is disclosed the adaptation of a dual resistive heating element mounted in an electric water heater and wherein one of the elements of the dual element is a low power rated resistive heating element dedicated to receive power from an alternative electrical power source. In recent years, increasing attention has been directed to the use of photovoltaic PV panels and wind powered generators to supply energy to households to power electrical appliances including electric water heaters. A disadvantage of such system is their cost particularly when using photovoltaic panels and further that power is not always available if there is no sun or wind. However, with respect to PA panels, and with ongoing research and development, new solar panels are being developed to cut their cost and increase their efficiency. Because solar and wind alternative energy sources produce dc voltage, with some uses it is sometimes required to convert the dc voltage to a state where it can produce a regulated AC supply adequate to operate all sorts of household appliances including electric water heaters. Accordingly, such alternative power sources incorporate circuitry and microprocessor controllers to regulate the alternative energy supply and to operate PV panel arrays, at their maximum power point, in terms of electrical energy supply, during solar irradiation fluctuations. Nevertheless, because the water holding tank of a water heater becomes a storage tank for storing heat energy, the demand of KWh from the grid is reduced resulting in a cost saving to the end user and permitting the grid provider to better manage its supply and allocate its power to other beneficial use.

Many solar energy system suppliers have developed proprietary solar systems to supply solar electrical power for various specific uses such as to charge battery packs for off-the-grid households or for other needs of such off-the-grid users. Others have proposed its connection directly to a resistive heating element of an electric water heater to convert the water heater into a hybrid electric/solar water heater. Some alternative energy suppliers have also developed their proprietary solar water heater systems, particularly those where thermal energy is obtained by the sun. However, such has proven costly and non-conventional resulting in future maintenance and repair problems.

In view of the above, it would be desirable to facilitate the adaptation of conventional electrical water heaters, using resistive heating elements to alternative energy suppliers and provide additional benefits to the end user and the grid provider by such an adaptation.

SUMMARY OF THE INVENTION

It is therefore a feature of the present invention to provide a multi-functional retrofit cover plate and assembly for use with electric water heaters to facilitate interconnection with alternative energy systems to heat water in its water holding tank to reduce the demand of electricity from the grid.

Another feature of the present invention is to provide a multi-functional retrofit cover plate and assembly wherein the cover plate has a dedicated internal compartment to accommodate an electronic switch unit and wiring connections required to adapt an alternative energy power source to an electric water heater and further provides for the mounting of other accessories of the alternative energy providers on the outer surface of the cover plate.

A further feature of the present invention is to provide a multi-functional retrofit cover plate and assembly which includes a replacement dual resistive heating element, a temperature sensor assembly and an electronic switch unit as well as all required wiring while providing electrical protection of the component assembly.

Another feature of the present invention is to provide a multi-function retrofit cover plate and assembly and wherein a display module is secured to an outer surface of the cover plate to provide an indication of the operational state of the alternative energy source connected to a dedicated resistive heating element and/or the actual water temperature in the tank of the water heater.

Another feature of the present invention is to provide a multi-functional retrofit cover plate and assembly including an electronic switching unit which prevents the water temperature within the tank of the electric water heater from exceeding a safe threshold value to prevent scalding.

Another feature of the present invention is to provide a multi-functional retrofit cover plate and assembly which includes an electronic switching unit incorporating a programmable electronic control circuit capable of causing the water temperature in the tank of the water heater to increase to a high temperature below the set temperature of the high limit switch to convert the water heater to a high temperature water heater and thereby increase the supply of hot water to the hot water distribution conduits and through a retrofit mixing valve and thereby resulting in a decrease of the demand of electricity from the grid.

A further feature of the present invention is to adapt an electrical water heater to an alternate thermal energy supply source to heat water in the tank of the water heater during predetermined water temperature conditions in the tank and when such thermal energy is available.

A still further feature of the present invention is to adapt a thermal fluid energy supply to a dual heating element having a resistive heating element and a fluid conductive conduit through which a hot fluid from an alternative energy supply is conducted.

Another feature of the present invention is to provide an electric water heater provided with a bottom dual resistive heating element and wherein a dedicated resistive heating element thereof is adapted for connection to an alternative supply voltage of a renewable energy source to heat water in a water holding tank of the electric water heater when a threshold temperature in the bottom region of the water holding tank rises above a threshold temperature as detected by a dedicated water temperature sensor mounted on the outer surface of the tank in a bottom access area of the tank.

A further feature of the present invention is to provide a method of retrofitting an electrical water heater to adapt to an alternative energy system to heat water in a water holding tank to reduce the demand on electricity from the grid and which further prevents the water temperature within the tank to exceed the set threshold water temperature of the high temperature limit switch of the water heater.

Another feature of the present invention is to provide a method of converting an electrical water heater to an alternative thermal energy system by interconnecting a dual heating element of the electric water heater to a thermal fluid supply.

According to the above features, from a broad aspect, the present invention provides a multi-functional retrofit cover plate and assembly for an electric water heater to provide interconnection with an alternative energy system to heat water in a water holding tank of the electric water heater. The retrofit cover plate assembly is comprised of a cover plate adapted for replacement connection over a bottom access opening formed in an outer casing of the electric water heater to permit access to a bottom resistive heating element and an associated thermostat and electrical connections. The retrofit cover plate has an outwardly projecting formation to define an internal dedicated compartment behind the retrofit cover plate. The retrofit cover plate is dimensioned for close retention fit against an outer surface of the outer casing to isolate the bottom access opening. The retrofit cover plate further has one or more access openings leading to the internal dedicated compartment from outside the retrofit cover plate to permit passage of wiring. The retrofit cover plate assembly further includes a dual resistive heating element for replacement of the bottom resistive heating element of the water heater. An electronic switch unit is also provided with a power cut-off switch for connection to the alternative supply voltage and a dedicated resistive heating element of the dual resistive heating element of the alternative energy system. A temperature sensor is provided for mounting against the tank outer surface to sense water temperature inside the tank and supply a sensed temperature signal to the electronic switch unit.

According to another broad aspect of the present invention, there is provided multi-functional retrofit cover plate for an electric water heater to provide interconnection with an alternative energy system generating electric power to heat water in a water holding tank of the electric water heater. The retrofit cover plate is adapted for replacement of a cover plate of a bottom access opening formed in an outer casing of the electric water heater permitting access to a bottom resistive heating element and an associated thermostat and connections of the electric water heater. The retrofit cover plate has an outwardly projecting formation to define an internal dedicated compartment behind the retrofit cover plate. The outwardly projecting formation defines one or more outer surface mounting sections for securing electrical accessories of an associated alternative energy system. The retrofit cover plate is dimensioned for close retention fit against an outer surface of the outer casing to isolate the bottom access opening. The retrofit cover plate further has one or more access ports leading to the internal dedicated compartment from outside the retrofit cover plate to permit passage of wiring. The outwardly projecting formation also permits for the mounting of accessories associated with an alternative energy system and/or other devices mounted in the internal dedicated compartment.

According to another broad aspect of the present invention there is provided a multi-functional retrofit cover plate and assembly for an electric water heater to provide interconnection with an alternative thermal fluid energy supply to heat water in a water holding tank of the electric water heater. The retrofit cover plate assembly is comprised of a cover plate adapted for replacement connection over a bottom access opening formed in an outer casing of the electric water heater permitting access to a bottom resistive heating element and an associated thermostat and electrical connections. The retrofit cover plate has one or more outwardly projecting formations to define one or more internal dedicated compartments behind the retrofit cover plate. The retrofit cover plate is dimensioned for close retention fit against an outer surface of the outer casing to isolate the bottom access opening. The retrofit cover plate further has one or more access means leading to the one or more internal dedicated compartments from outside the retrofit cover plate to permit passage of associated elements of the assembly. The retrofit cover plate assembly further includes a dual bottom element for replacement of the bottom resistive heating element. The dual bottom element has a replacement resistive heating element and a thermal fluid conductive conduit having an inlet and an outlet end to permit the flow of a hot fluid there through to heat water in said tank. The assembly further comprises an electronic control unit, a temperature sensor and a pump. The pump is adapted for connection between the alternative thermal fluid energy supply and one of the thermal fluid conductive conduit of the dual bottom element. The temperature sensor is adapted for mounting on an outer surface of the tank and for communication with the electronic switch unit for feeding a temperature signal representative of a set threshold temperature of water within the tank in a lower region of the tank. The electronic control unit controls the operation of the pump to control the flow of the hot fluid through the thermal fluid conductive conduit of the dual element for heat exchange with water in the tank.

According to another broad aspect of the present invention there is provided an electric water heater having a bottom dual resistive heating element and wherein a dedicated resistive heating element thereof is adapted for connection to an alternative supply voltage of a renewable energy source. The electric water heater has a cover plate adapted for connection over a bottom access opening formed in an outer casing of the electric water heater to permit access to the bottom dual resistive heating element and an associated thermostat and electrical connections. The cover plate has an outwardly projecting formation to define an internal dedicated compartment behind the cover plate. The cover plate is dimensioned for close retention fit against an outer surface of the outer casing to isolate the bottom access opening. The cover plate further has one or more access means leading to the internal dedicated compartment from outside the cover plate. The dedicated resistive heating element has power leads for connection to the supply voltage from the alternative energy system. An electronic switch unit is housed in the dedicated compartment and controls a power cut-off switch for connection to the alternative supply voltage and the dedicated resistive heating element of the dual resistive heating element. A temperature sensor is mounted on an outer surface of the water holding tank for feeding a temperature signal to the electronic switch unit indicative of a set threshold water temperature within the tank in a lower region thereof to cause the electronic switch unit to trip the cut-off switch upon receiving a temperature signal indicative of the threshold water temperature According to a further broad aspect of the present invention there is provided a method of retrofitting an electrical water heater to an alternative energy system to heat water in a water holding tank of the electric water heater. The method comprises the following steps:

i) providing a retrofit cover plate for replacing an existing cover plate secured over a bottom access opening formed in an outer casing of the electric water heater to permit access to a bottom resistive heating element and an associated thermostat and electrical connections, the retrofit cover plate has an outwardly projecting formation to define an internal dedicated compartment between the retrofit cover plate and an outer surface of the outer casing;

ii) replacing the bottom resistive heating element with a dual resistive heating element having one resistive heating element which is a dedicated resistive heating element to receive alternative operating voltage from the alternative energy system;

iii) mounting a temperature sensor against an outer surface of the water holding tank to sense water temperature in a lower region of the water holding tank;

iv) mounting an electronic switch unit having a normally closed power cut-off switch in the internal dedicated compartment and establishing power connections thereto, and v) connecting leads of the temperature sensor to the electronic switch unit to feed actual sensed water temperature signals to the electronic switch unit for the monitoring of the temperature signals to cause the normally closed power cut-off switch to open and disconnect the alternative supply voltage from the dedicated resistive heating element upon the temperature signals attaining a threshold temperature value.

According to still broad aspect of the present invention there is provided a method of connecting an electrical water heater to an alternative thermal energy system by interconnecting a dual heating element of said electric water heater to a thermal fluid supply. The method comprises the following steps:

i) providing a retrofit cover plate and an assembly for replacing an existing cover plate secured over a bottom access opening formed in an outer casing of the electric water heater permitting access to a bottom resistive heating element and electrical connections; the retrofit cover plate having one or more outwardly projecting formations to define one or more internal dedicated compartments between the retrofit cover plate and an outer surface of the outer casing;

ii) replacing the bottom resistive heating element with the dual resistive heating element having a replacement resistive heating element and the other being a thermal fluid conductive conduit adapted to receive and conduct a hot fluid there through from the alternative thermal fluid energy supply;

iii) connecting fluid circulating conduits of the alternative thermal fluid energy supply to the thermal fluid conductive conduit;

iv) mounting a fluid cut-off valve to one of the fluid conducting conduits prior to connection to the thermal fluid conductive conduit:

v) mounting a temperature sensor against an outer surface of the water holding tank to sense water temperature in a bottom region of the water holding tank;

vi) mounting an electronic switch unit having a normally closed power cut-off switch in one of the internal dedicated compartments and establishing power connections thereto;

vii) connecting leads from the cut-off switch to the pump to provide operating voltage to the pump through the cut-off switch, and viii) establishing communication between the temperature sensor and the electronic switch unit for the temperature sensor to transmit one or more temperature signals to the electronic switch unit upon the temperature sensor detecting a predetermined threshold temperature wherein the electronic switch unit will cause the pump to stop the flow of the hot fluid through the thermal fluid conductive conduit of the dual element and resume the flow upon the water temperature in the tank falling below the threshold temperature.

DESCRIPTION OF THE DRAWINGS

A preferred embodiment of the present invention will now be described with reference to the accompanying drawings in which.

DETAIL DESCRIPTION OF THE PREFERRED EMBODIMENTS

Figure 1:
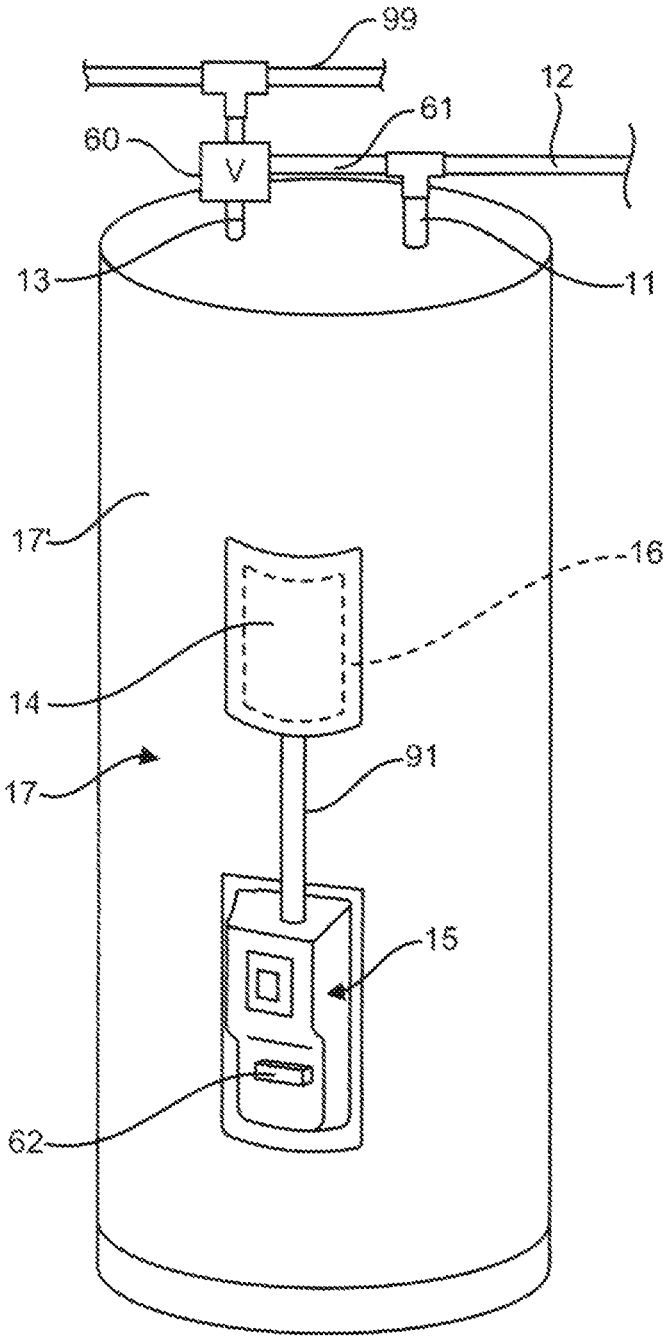
FIG. 1 is a perspective view illustrating an electric water heater fitted with the multi-functional retrofit cover plate of the present invention.

Referring now to the drawings, and more particularly to FIG. 1, there is shown generally at 10 a standard two element electric water heater which has been modified to incorporate the multi-functional retrofit cover plate 15 of the present invention mounted over the bottom access opening and which provides access to a bottom resistive heating element and associated thermostat, as is provided with electrical water heaters. The electric water heater 10 has an inlet water conduit 11 connected to a domestic pressurized water line 12 to supply replenishing water under pressure to the bottom region of the tank, through a dip tube, not shown but obvious to a person skilled in the art. When hot water is drawn out from the top of the tank through outlet conduit 13, cold water under pressure is admitted into the bottom area of the tank through inlet conduit 11. As herein shown, a cover plate 14 is secured over the uppermost access opening 16, shown in phantom lines, for access to a top resistive heating element and its associated thermostat and wiring connections. This cover plate is substantially a flat metal plate which has the curvature of the tank outer casing 17 and sized to cover the access opening 16.

Figure 2:
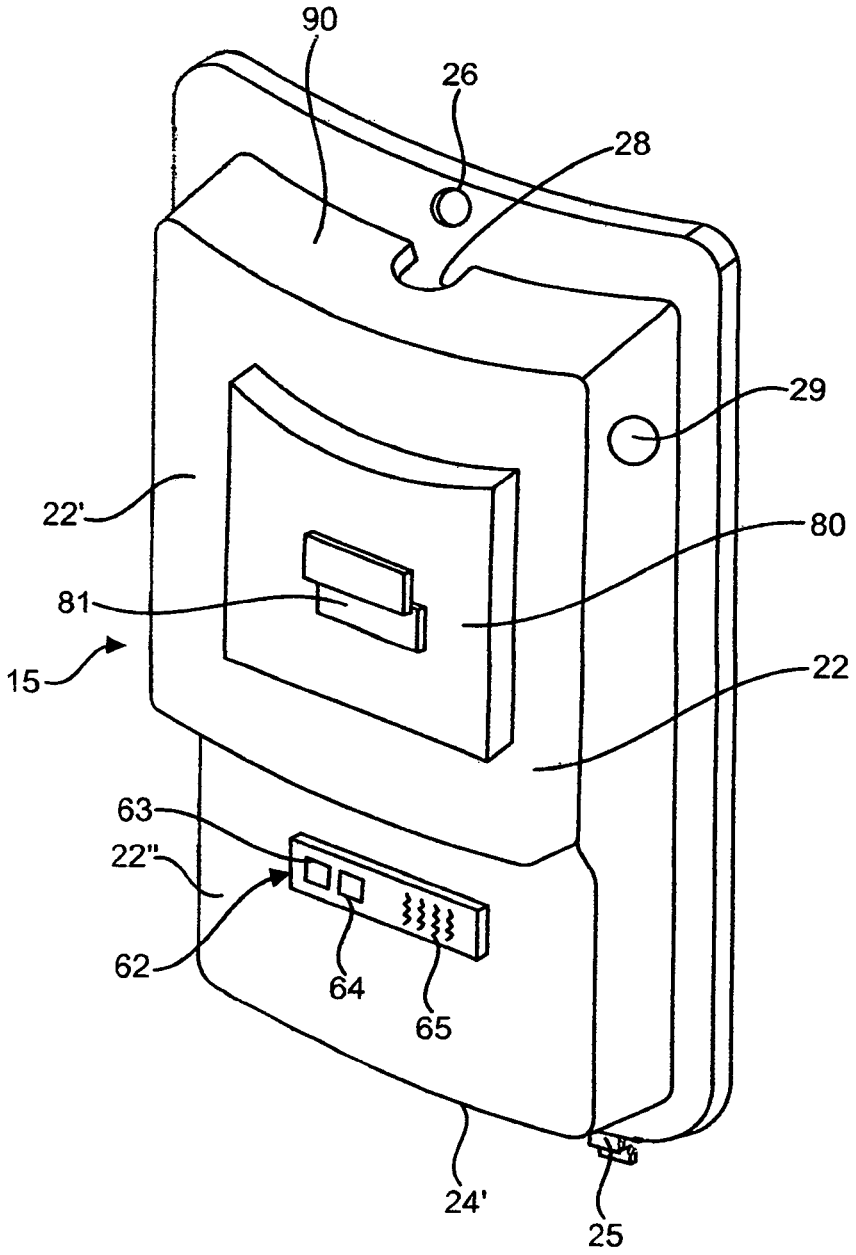
FIG. 2 is a perspective view of the retrofit cover plate.
Figure 3:
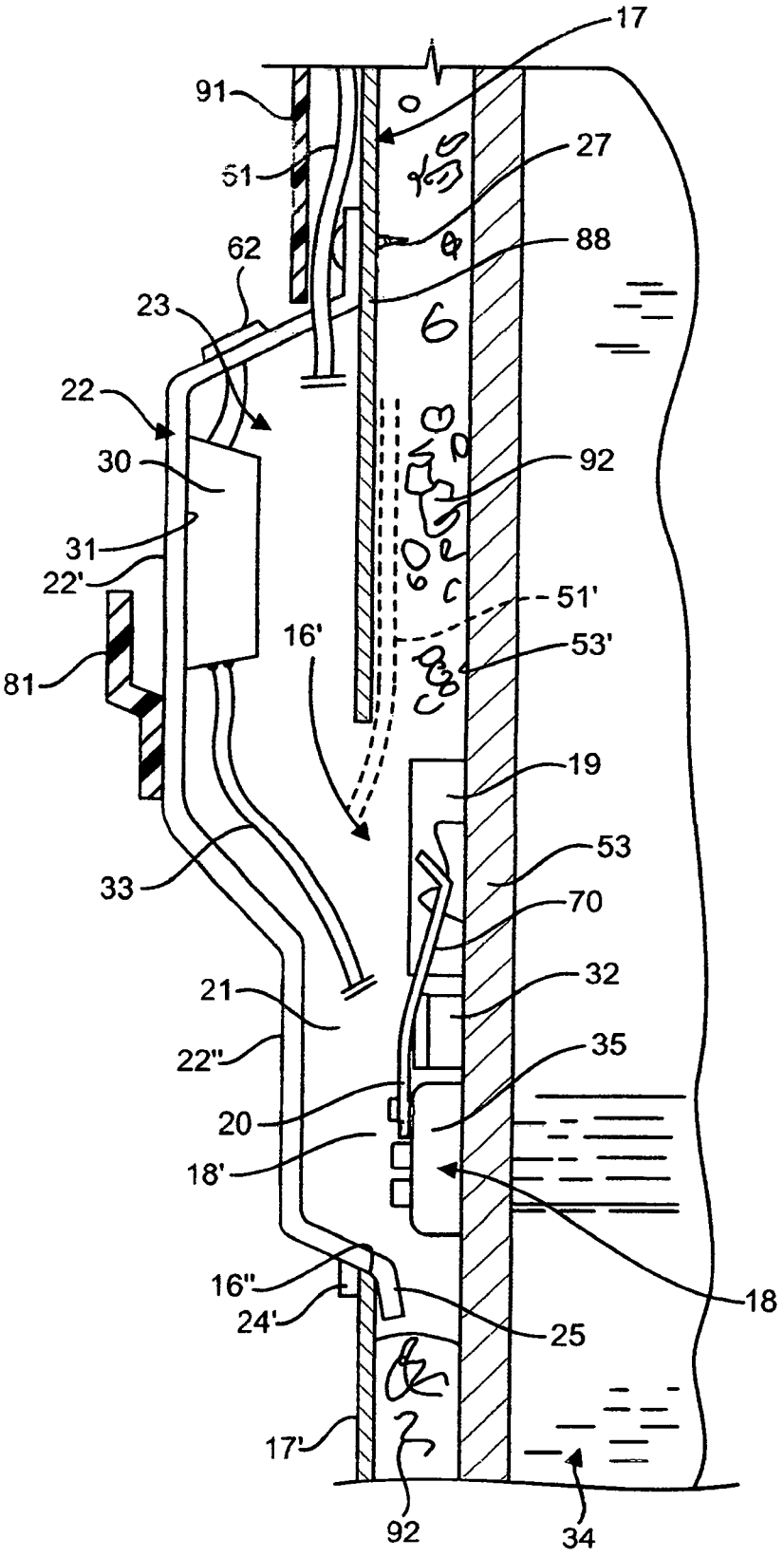
FIG. 3 is a cross-sectional view of the retrofit cover plate illustrating the cover plate and accessories of the assembly associated with the cover plate mounted in the dedicated compartment and the access opening, as well some wiring and external accessories.

With additional reference now to FIGS. 2 and 3 there will be described the construction and installation of the retrofit cover plate 15 and its assembly with other components and electrical connections of the water heater to provide interconnection with an alternative electrical energy system, being a solar panel or wind turbine alternative energy system. The retrofit cover plate 15 is constructed and shaped for replacement connection over a bottom access opening 16', as shown in FIG. 3, to permit access to a bottom resistive heating element 18 and its wire terminals 18', an associated thermostat 19 and its support bracket 21. As herein shown, the retrofit cover plate 15 is shaped to define an outwardly projecting formation 22 to define an internal dedicated compartment 23 behind the retrofit cover plate. As shown the projecting formation 22 has a top section 22' which projects outwards a greater distance than the bottom section 22" to provide for the mounting of internal components in the top part of the dedicated compartment 23. The bottom section 22" is less pronounced to accommodate wiring to and from the top section 22' and from outside the retrofit cover plate 15. The retrofit cover plate is also formed with a peripheral flange section 24 in at least part thereof for flush contact mounting against the outer surface 17' of the outer casing 17 to isolate the access opening 23. As shown in FIGS. 2 and 3, the peripheral flange 24 is removably secured about the bottom access opening 16' by a pair of bottom tongues 25 projecting inwardly of a bottom edge 24' of the cover plate for retention over a bottom edge 16" of the access opening 16'. A hole 26 is provided in the top end of the flange 24 to receive a screw 27 there through for securing the cover plate to the outer surface 17'*of* the outer casing 17, as shown in FIG. 3. The retrofit cover plate 15 is further provided with holes 28 and/or nock-outs 29 at specific locations for the passage of wiring associated with the water heater and control(s) or other devices or modules of the alternative energy system to which it is connected to and leading to the internal dedicated compartment 23.

Figure 6:
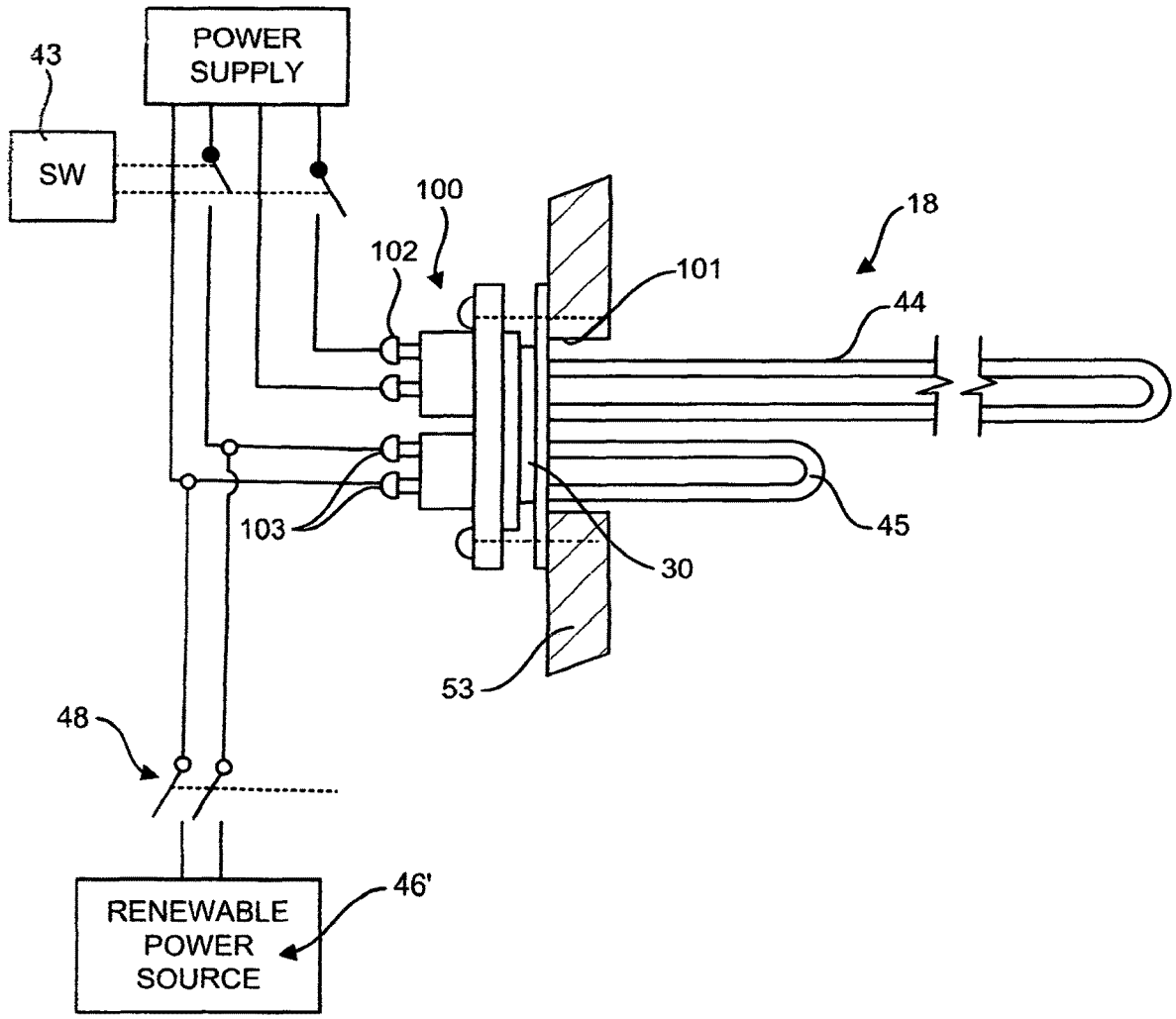
FIG. 6 is a side view illustrating a dual resistive heating element mounted on the tank of an electric water heater and its connections to an alternative power supply through the electronic switching unit of the retrofit cover plate assembly of the resent invention.

As illustrated in FIG. 3, the retrofit cover plate assembly includes an electronic switch unit 30, the purpose of which is described below, and which is herein shown secured to the inner surface 31 of the cover plate in the dedicated compartment 23. The assembly also includes a temperature sensor 32 associated with the switching unit through wiring 33 to feed a signal of a set threshold temperature, herein 140 degrees Fahrenheit, or the sensor may be of a type capable to feed actual temperature signals of the water contained in the water holding tank 34, a fragment of the tank herein being illustrated. Also included in the assembly is a dual resistive heating element 35 as better shown in FIG. 6. Dual resistive heating element are known in the art and the function of the one illustrated in FIG. 6 is described in detail in U.S. Pat. No. 9,885,498, which is incorporated herein by reference.

Figure 4:
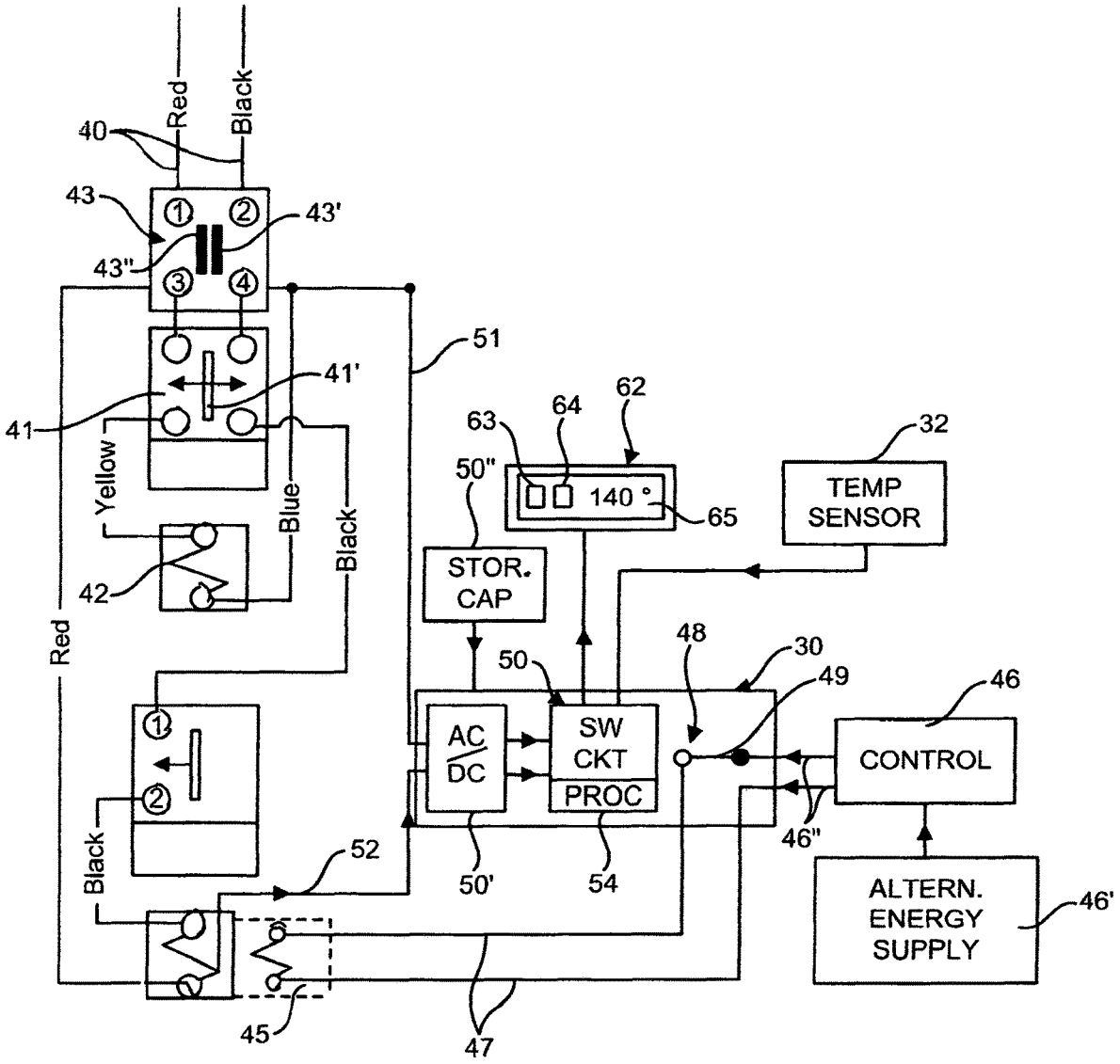
FIG. 4 is an electrical wiring diagram of a two element electric water heater connected to a 2-phase voltage supply and to which is incorporated a dual resistive heating element and a block diagram of the electronic switch unit with its connections to associated devices.

With reference now to FIG. 4, there is illustrated the wiring connections of a two resistive heating element electric water heater and to which the assembly of the retrofit cover plate is adapted to. As herein shown, the 240 volts AC supply voltage between leads 40, enters the top thermostat 41 associated with the top resistive heating element 42 through a normally closed high temperature limit switch 43, the switch being illustrated herein as in an open condition. This limit switch 43 is a protection switch to shut-off the voltage to the water heater and is triggered to an open state if the water temperature in the tank exceeds a set threshold water temperature value, usually 170 degrees Fahrenheit, and which temperature could cause scalding of the skin if it comes in contact with a user person. If the limit switch is triggered due to the water temperature exceeding the threshold value, then the power supply is cut off and it then becomes necessary to manually reset the limit switch. The reset now requires a technician which needs to be called for a service call in order to reset the switch. This often results in the consumer being deprived of hot water for a prolong period of time. Therefore, it is important to prevent such a situation to occur if water within the tank is heated by other means, such as an alternative energy supply, which does not have the control of the thermostats associated with the two resistive heating elements.

Figure 5:
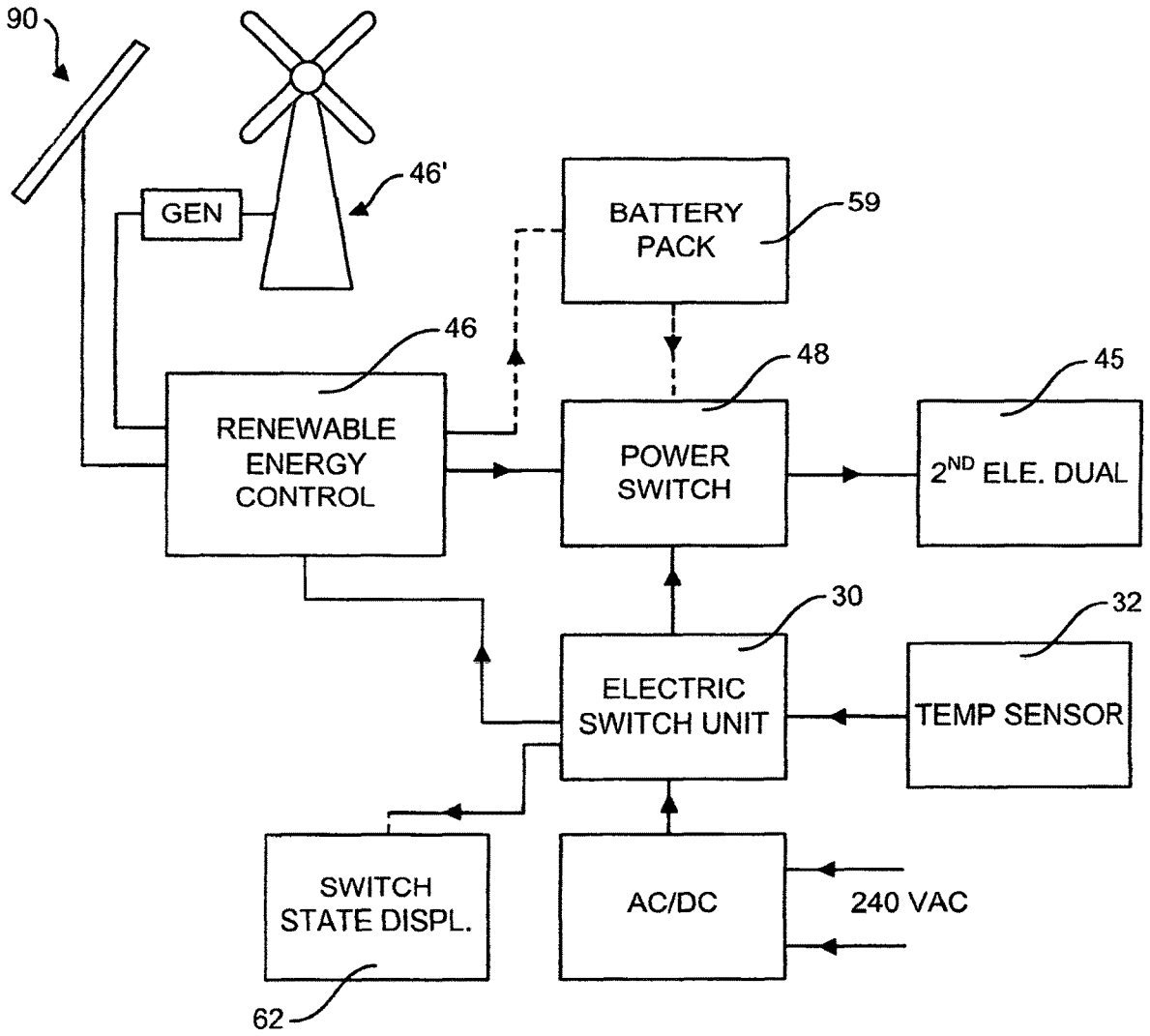
FIG. 5 is a block diagram of an alternative energy provider system connected to an electrical water heater equipped with the multi-functional cover plate assembly of the present invention.

As mentioned above, FIG. 4 illustrates a standard wiring for the operation of a two element water heater, and a detail description of its operation is not deemed necessary herein, as it is obvious to a person skilled in the art. However, it is illustrated herein to show how the elements of the retrofit cover plate assembly is interconnected thereto. With additional reference to FIGS. 5 and 6, the bottom dual resistive heating element 18 has a first and a second resistive heating element, 44 and 45, respectively, with the first resistive heating element 44 being a replacement resistive heating element to the conventional bottom resistive heating element secured to the water heater. The second resistive heating element 45 is dedicated to the alternative voltage to be supplied usually by a controller 46 of a renewable supply source 46'. As shown in FIG. 5, if the alternative energy source is a photovoltaic voltage supply system including a PV panel array, as schematically shown at 90, maximum dc power is extracted from the panel array when there is solar radiation and is converted to an AC driving voltage supply by inverter circuitry, not shown herein as not forming part of the present invention, but represented in block form as part of a control 46, to supply on its output leads 46", see FIG. 4, the dedicated resistive heating element 45. The dedicated resistive heating element 45 has a power rating lower than the first resistive heating element 44 and in a range not greater than a maximum of about 4000 watts.

The dedicated resistive heating element is selected to function to accommodate both dc and AC voltages and such is accomplished by the material selection for the construction of the resistive heating element to adapt it to the specification of the alternate energy supply. The dedicated resistive heating element 45, as schematically shown in FIG. 4, is secured by leads 47 secured to the alternative energy source 46' through a controller 46. One of the leads 47 has a normally closed power switch 48 connected thereto. The switch can be a relay or an electronic switch. Accordingly, when the switch contact arm 49 is closed, the supply voltage from the alternative energy supply operates the resistive heating element 45. When the arm 49 is open it cut-off the alternative supply from the dedicated resistive heating element 45. It is common with PV panel arrays 90 to charge a battery pack 59, as shown in FIG. 5, to create a reserve of power for use when there is no or very little solar radiation or during nigh time. When power packs are available, then the dual element is provided with a dedicated resistive heating element 45 to accommodate dc voltage and it is connected to the battery voltage supply of the batteries a 59 through the power switch 48. Accordingly, the dedicated resistive heating element 45 can function on a substantially continuous basis provided that the battery pack maintains a charge.

As shown in FIG. 6, the dual resistive heating element 18 is secured to an insulated mounting support assembly 100 for connection about a heating element port 101 formed in the tank side wall 53 the water holding tank, and such mounting is well known in the art. As shown, the first and second resistive heating elements, 42, 45, are secured to the support assembly 100 in a spaced-apart relationship and insulated from one another by the insulated mounting support assembly. The first and second resistive heating elements have external electrical connectors 102, 103, respectively, for receiving voltage supplied thereto from the AC power supply of the electrical water heater for the replaced bottom heating element and for receiving dc or AC supply voltage from the alternative energy system for the second resistive heating element 45.

As shown in FIGS. 4 and 5, the electronic switch unit 30 receives the AC supply of the water heater through an ac/dc converter 50' to supply dc operating voltage for the electronic switching circuit 50 for operation thereof. The input voltage is derived from input lead 51 and 52 connected to terminals which receive power leads from the input leads 40 through the high temperature limit switch 43. The electronic switching unit 30 is also provided with a storage capacitor 50" to store electrical power and act as a battery to maintain the electronic circuits operational with the alternative energy system in the absence of electrical power form the grid. Accordingly, if there is a power failure from the grid, the alternative energy supply will automatically operate the dedicated resistive heating element as soon as the temperature sensor senses a drop in water temperature below the threshold of 140 degrees Fahrenheit and hot water supply will be maintained. The temperature sensor 32, which is mounted against the outer surface 53' of the water holding tank side wall 53, as shown in FIG. 3, provides a preset signal to the switching circuit 50 only when a threshold temperature is attained.

The sensor 32 may be of a type which is capable of monitoring the water temperature in the lower region of the tank where the temperature sensor is secured and to feed continuous temperature signals to the electronic switching circuit which is provided with a processor 54 to monitor actual temperature and to feed these signals to the module 62 secure to the outer surface of the cover plate 15. The switching circuit 50 is programmed to cause the switching circuit unit 30 to actuate the power switch 48 to an open contact position cutting off the renewable energy supplied to the dedicated resistive heating element 45 when the detected water temperature exceeds an unsafe threshold water temperature value as programmed in the processor 54.

As shown in FIGS. 1 and 3, the input feed lead 51 can run externally of the outer casing 17 from the bottom of the top cover plate 14 to the top of the retrofit cover plate 15 where it enters the dedicated compartment 23 through an access opening or hole 28 in the top wall 90 of the retrofit cover plate 15 or other suitable location. A protective plastic cover channel member 91 is secured over the feed lead 51 for protection. On the other hand, the feed lead, as shown in FIG. 3 and designated by reference numeral 51', can be fished through the foam insulation 92 inside the inner surface 88 of the outer casing 17 and caused to exit into the access opening 16 and into the dedicated compartment 23 for its connection to the electronic switch unit 30.

It is pointed out that the retrofit cover plate assembly of the present invention also provides the benefit of further modifications of the water heater should there be a desire to convert the water heater to a high temperature water heater particularly in regions where alternate energy supply is plentiful, such as in regions where there is ample sunshine hours, to maintain the water temperature above 140 degrees Fahrenheit. By mounting a mixing valve 60 on the outlet conduit 13 of the water heater, as shown in FIG. 1, and establishing a conduit connection 61 to the household water supply conduit 12, the water temperature in the tank can be raised up to about 165 degrees Fahrenheit and thereby increasing the hot water volume that can be supplied to the consumer without the risk of scalding in view of the mixing valve connection which reduces the temperature of the hot water supplied to the distribution conduit 99, as herein illustrated. Such an arrangement would further reduce the demand for electrical energy from the grid as well as reducing the cost to the consumer. By programming the processor 54 to a threshold water temperature of about 165 degrees Fahrenheit, or slightly lower, the high limit switch 43 would be prevented from tripping to an open condition which would cut off the power supplied to the water heater and then requiring a service call to reset the high limit switch As shown in FIGS. 2, 3 and 4, a switch state indicating display module 62 is mounted on the outer surface of the cover plate 15 at a convenient location and receives signals from the electronic switch unit to display the state of the power switch 48. As herein illustrated the display module 62 is provided with two lights, a green light 63 indicating that the switch is in a "closed" condition and a red light 64 indicating that the switch is "open", indicating that the alternative energy supply has been cut-off. As mentioned above, power switch 48 is a normally closed switch with its connection to the alternate power source remaining connected for the reason that there is no alternative voltage supply during nighttime or when there is no wind. The display module 62 is herein shown as also containing a screen 65 to provide a display of the actual temperature of the water in the tank at the location of the temperature sensor 32.

Figure 7:
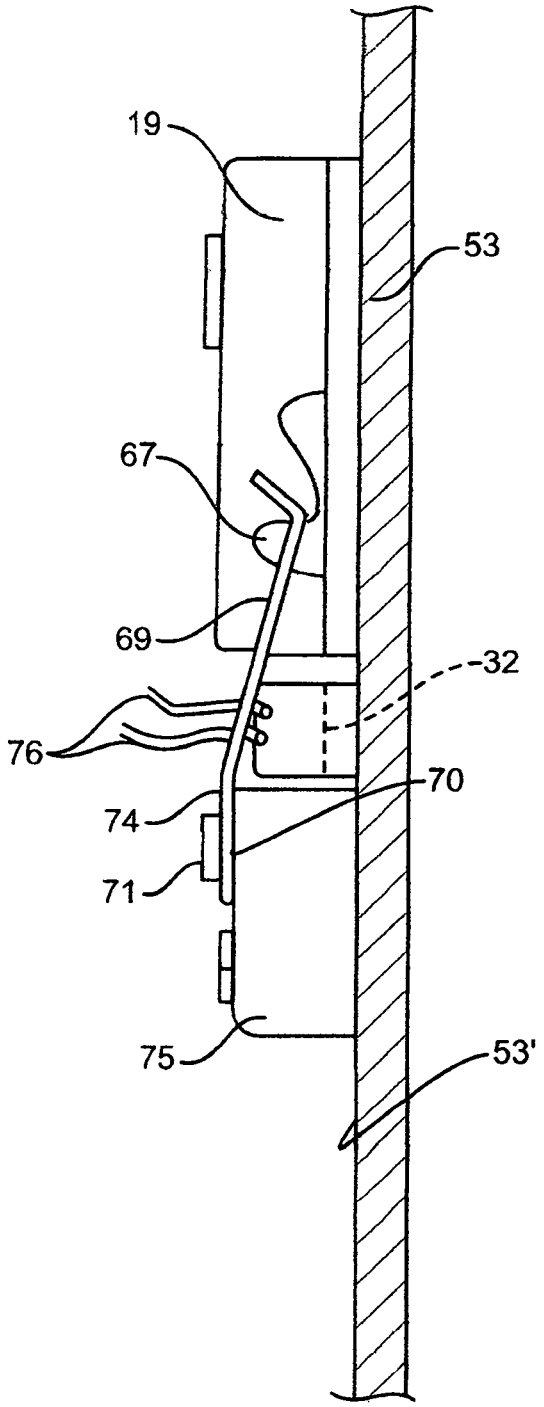
FIG. 7 is a side view illustrating the mounting of the temperature sensor between the thermostat and its associated resistive heating element and supported in contact position against the tank outer surface by the sensor support clamp held in position by the thermostat support bracket.
Figure 8:
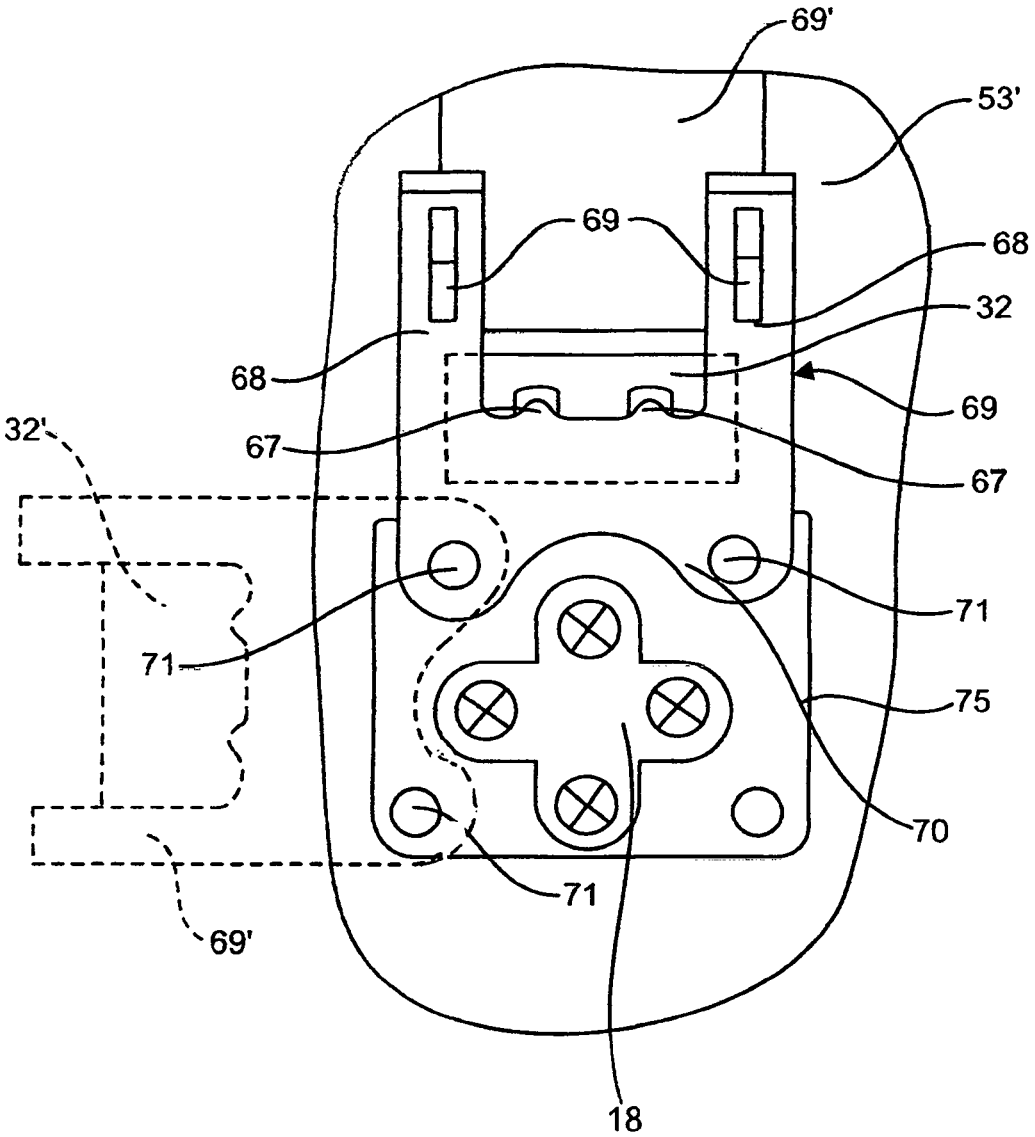
FIG. 8 is a rear view of the thermostat support bracket which is utilized to mount a thermostat associated with the bottom resistive heating element against the outer surface of the water holding tank to sense water temperature in the tank and to set a desired operating water temperature at which the thermostat will trip the power connections to its associated resistive heating element, herein the bottom element.
Figure 9A:
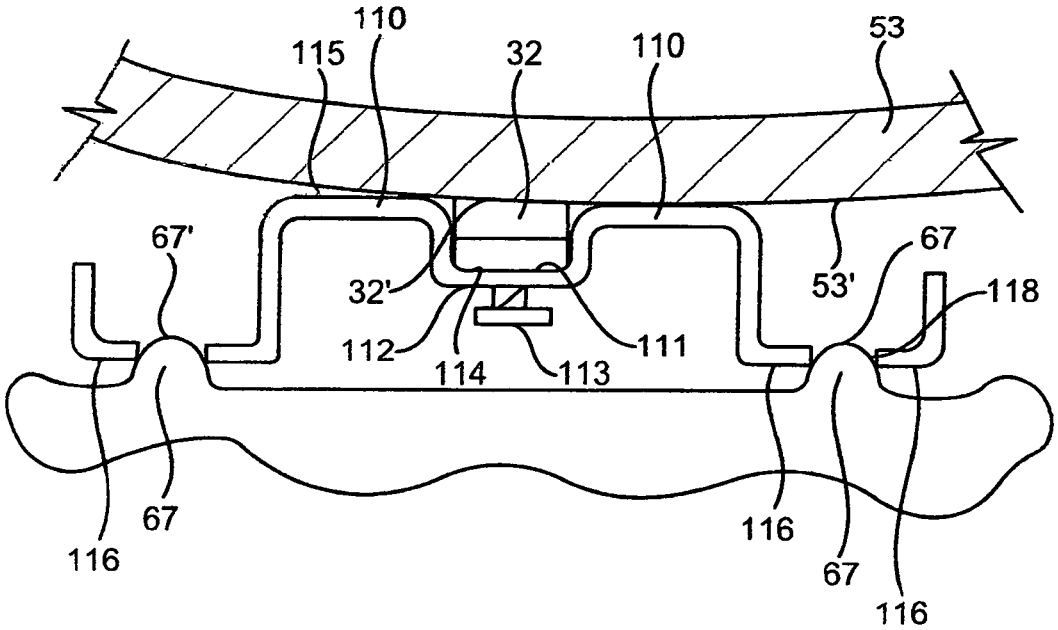
FIG. 9A is a fragmented cross-sectional view showing the temperature sensor mounted in its support clamp and secured in position which is removably connected to the thermostat support bracket and biased against the outer surface of the water holding tank.
Figure 9B:
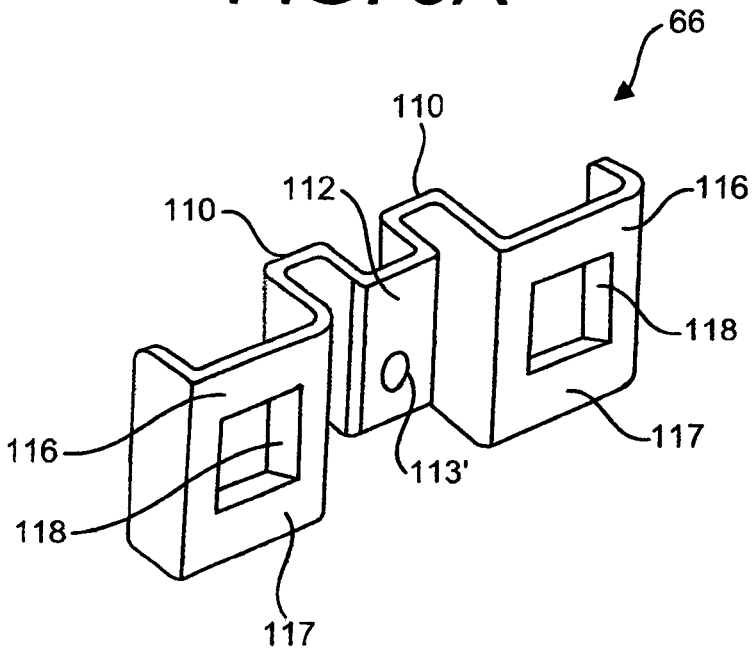
FIG. 9B is a perspective view of the temperature sensor support clamp.

With reference to FIGS. 7 to 9B, there will now be described the mounting of the temperature sensor 32 against the outer surface 53' of the water holding tank side wall 53, as illustrated in FIG. 7. The temperature sensor 32 is mounted on a temperature sensor support clamp 66, as shown in FIGS. 9A and 9B. The support clamp 66 is formed from a single flat rectangular metal piece which is shaped to define a rear wall 110 provided with a forwardly projecting recess 111 defining a rectangular cross-section sized to receive the temperature sensor 32 therein. The temperature sensor 32 is attached to a rear support wall 112 provided with a threaded hole 113' to receive an end of an attachment fastener 113 for mounting the temperature sensor behind a rear support wall 114 in the recess 111. The fastener 113 provides for mounting and displacement of the contact face 32' of the sensor 32 against the outer surface 53' of the water holding tank side wall 53. The adjustment of the fastener ensure that the outer surface 53' of the sensor projects slightly spaced above the rear face 115 of the rear wall 110.

The temperature sensor support clamp 66 also defines opposed forwardly projecting arms 116, also of substantially rectangular cross-section, with each arm 116 defining a flat front wall 117 lying in a common plane and each having a connecting aperture 118 to receive a forward bight portion 67' of connecting tabs 67 formed between a pair of connecting arms 68 of a thermistor support bracket 69 for holding the thermistor 69' associated with the bottom dual resistive heating element 18, as more clearly illustrated in FIGS. 9B, 7 and 8.

With reference now to FIGS. 7 and 8 there will be described the mounting of the temperature sensor 32 against the outer surface 53' of the water holding tank side wall 53. The bottom section 70, the thermostat support bracket 69 is detached by unscrewing the bolts 71 which secures the support bracket 69 on the top end of the terminal block 75 of the dual resistive heating element 18. The temperature sensor is already mounted on its support bracket 69 and the bracket 69 as well as the thermostat 69' are held in position against the outer side wall 53' of the tank and in alignment with the thermostat support bracket 69 which is reconnected to the top end of the terminal block to bias the thermistor 69' and the temperature sensor 32 firmly against the tank wall outer surface 53'. The leads 76 of the sensor 32 are then connected to the proper terminals of the electronic switch unit 30. As shown in phantom lines in FIG. 8, the temperature sensor 32' may also be mounted to a side of the terminal block 75 by a support bracket 69' particularly if the sensor is of a larger size and cannot be accommodated in the space between the thermistor and the terminal block 75. The bracket 69' may also be shaped differently to hold the temperature sensor firmly against the outer surface of the tank.

Figure 10:
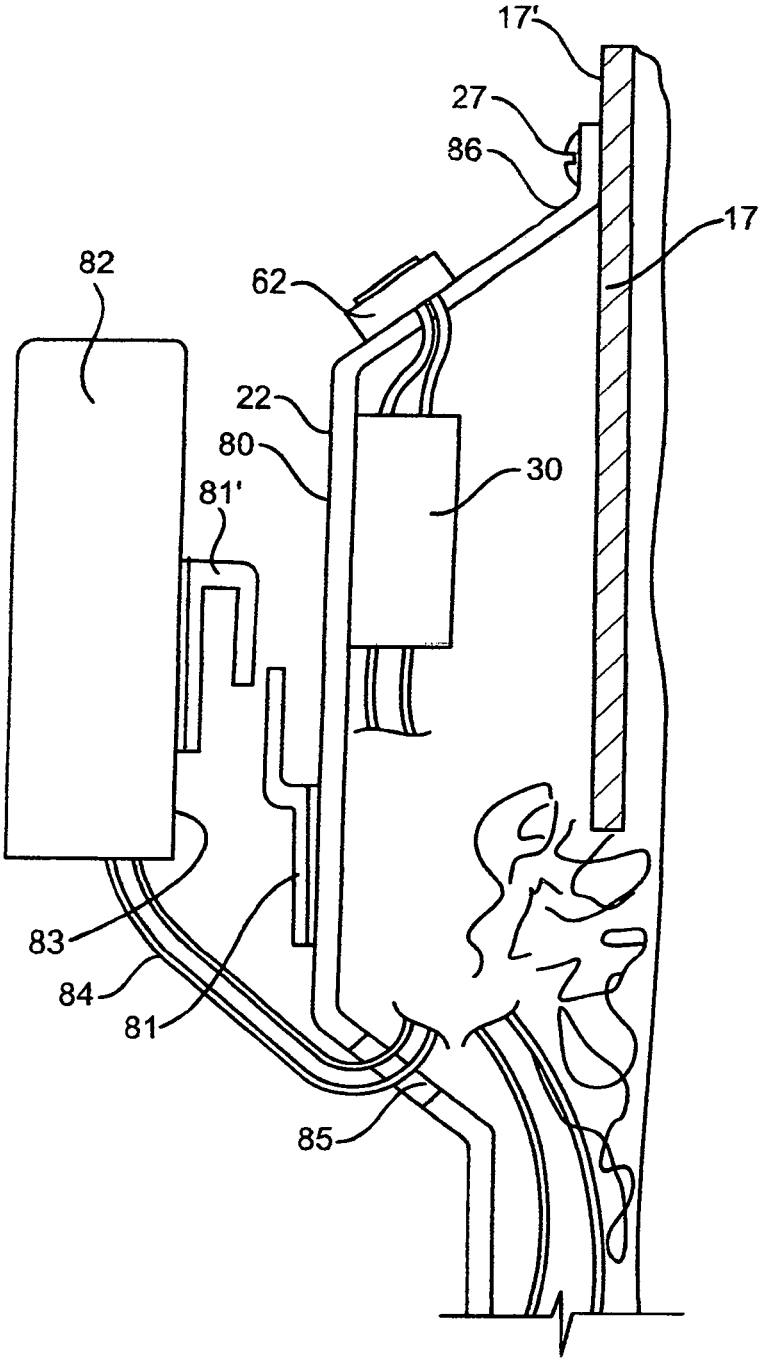
FIG. 10 is a cross-sectional view illustrating the adaptation of an electrical device or module of an alternative energy supply system attached to the cover plate and wherein an insulating bat is shown positioned against the bottom access opening to insulate the area of the access opening.

Many renewable energy system are known and their systems require control devices mounted in a housings or modules and some of these are provided with a display screen to display information concerning the operation of the system for monitoring. The multi-functional cover plate of the present invention, as illustrated in FIGS. 1, 2, 3 and 10, is designed to accommodate such control devices by forming the outer projecting formation 22 with at least a section thereof having a flat surface section 80 as shown in FIG. 2. As herein shown, a first part of a support bracket 81 is adhesively secured to the flat surface section and a second matting part 81', see FIG. 10, is adhesively attached to a rear wall 83 of a control module 82 of the alternative energy system with the bracket providing ease of attachment and disconnection. The support bracket also permits wiring 84 from the control module to be inserted in a knock-out aperture 85 conveniently positioned with respect to the control module to provide for its connection to component parts and connectors in the access opening and mounted in the dedicated compartment 23 without any strain applied to the wiring 84. As shown in FIG. 10, the display module 62 is herein shown mounted on a top surface 86 of the outwardly projecting formation 22. The flat outer surface 80 may also be formed with an upwardly inclined angle to facilitate the view of the control module 82, particularly if it contains a display screen. On the other hand, a customized support bracket may be secured to the outer surface 80 for adaptation of specific devices associated with the alternative energy systems. Where the alternative energy system has a capacity dedicated to supply other devices, such as is the case in off-the-grid homes equipped with battery packs, all the controls and other devices are mounted on a panel and only a feed lead is secured to the water heater.

In summary, the retrofit cover plate assembly of the present invention, as shown in FIGS. 1 to 10 provides for an easy adaptation of alternative electrical energy systems to electric water heaters and this is accomplished by providing a retrofit cover plate for replacing the existing cover plate secured over a bottom access opening formed in an outer casing of the electric water heater. The bottom cover plate provides access to the bottom resistive heating element and its associated thermostat and electrical connections. The retrofit cover plate has an outwardly projecting formation which defines an internal dedicated compartment between the retrofit cover plate and an outer surface of the outer casing for mounting and storage of assembly components.

The standard bottom resistive heating element is replaced with the dual resistive heating element, forming part of the retrofit assembly, and which has a dedicated resistive heating element to which is connected the alternative voltage supply from the alternative energy system. The assembly further includes a temperature sensor with an adapter for mounting the temperature sensor against an outer surface of the water holding tank to sense water temperature in a lower region of the water holding tank. An electronic switch unit is further provided in the assembly with a normally closed power cut-off switch and these are mounted in the internal dedicated compartment. Electrical connections from the wiring of the thermostat and resistive heating elements are made to provide power to operate the electronic switching unit. Output leads from the temperature sensor are secured to the electronic switch unit to feed a set threshold high temperature signal when attained or to provide actual temperature signals to the electronic switch unit for the monitoring of changing temperature signals detected by the sensor to cause the normally closed power cut-off switch to open and disconnect the alternative supply voltage from the dedicated resistive heating element upon the temperature signals attaining a threshold temperature value set in the electronic switch unit.

Figure 11:
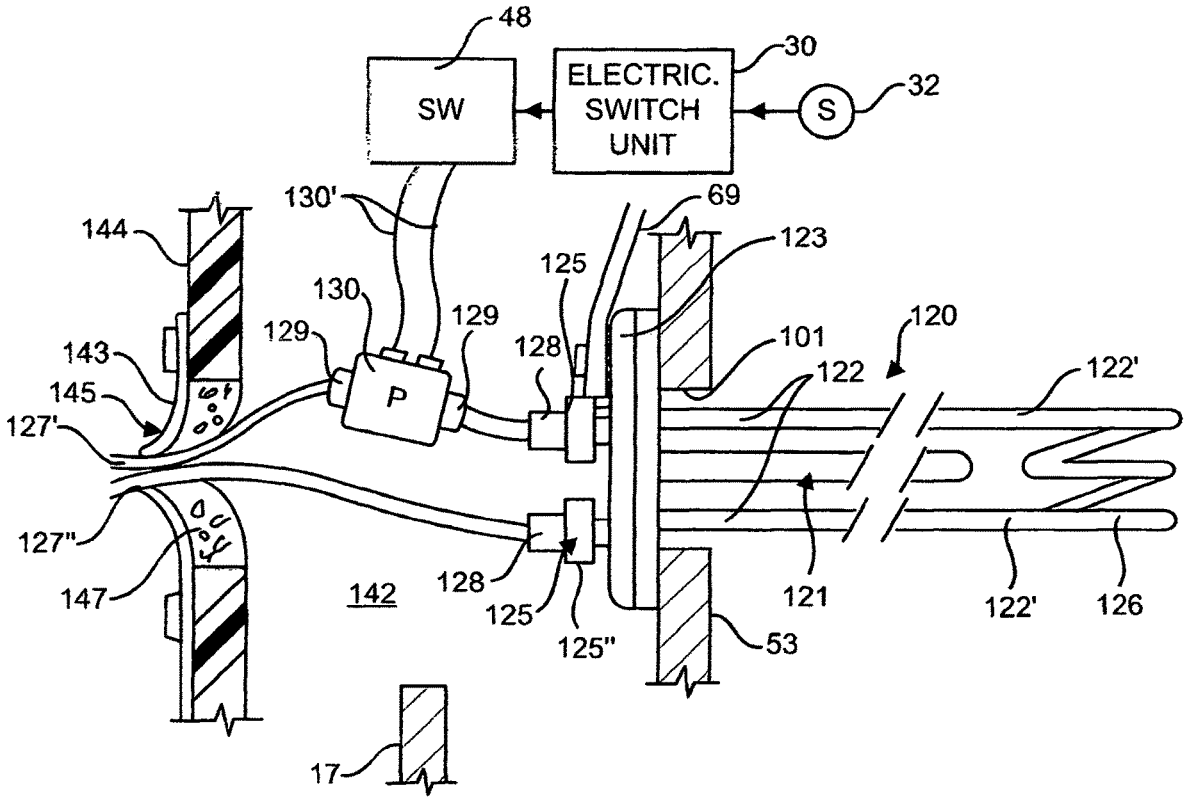
FIG. 11 is a fragmented section view showing the dual element of the present invention secured to the tank to replace the bottom resistive heating element and wherein the dual element has been adapted to receive a hot fluid through a thermal fluid conductive conduit secured to the dual element in addition to a replacement resistive heating element.
Figure 12:
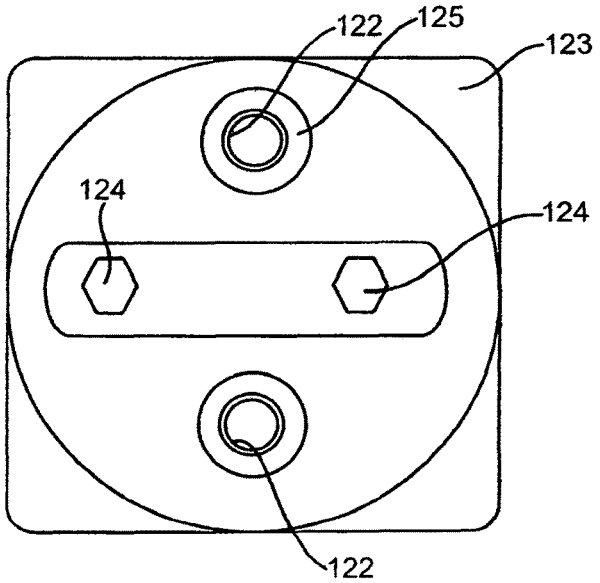
FIG. 12 is a rear view of the terminal block of the dual resistive heating element showing the connections thereto and their disposition on the terminal block.
Figure 13:
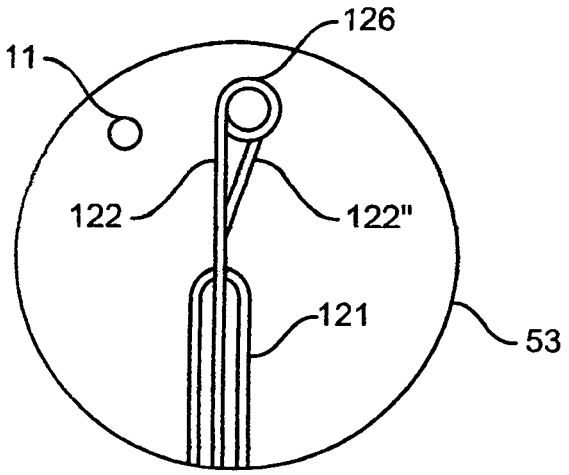
FIG. 13 is a simplified transverse section view showing the position of the replacement resistive heating element and the fluid conducting conduit of the dual element.

Referring now to FIGS. 11 to 14, there will be described a modified retrofit cover plate 15' and its assembly to adapt an electrical water heater to an alternative thermal fluid supply. As shown by these figures, for this purpose the dual element and cover plate are constructed differently. As shown in FIGS. 11 to 13, the dual element 120 replaces the existing bottom element of an electric water heater and is comprised of a replacement heating element 121, of a predetermined power rating, and a thermal fluid conductive conduit 122. The replacement heating element 121 and the thermal fluid conductive conduit 122 are mounted in transverse orientation on the terminal block 123, as shown in FIG. 12, of the dual element which is secured to the tank wall 53 as described above with respect to the mounting of the dual element 18. The terminals 124 of the resistive heating element 121 are disposed horizontally and the tube connecting fittings 125 of the fluid conductive conduit 122 are disposed vertically on the terminal block 123, and these are all accessible in the bottom access opening 16'.

The thermal fluid conductive conduit 122 is constructed from a single elongated copper tube, which is an excellent thermal conductive material, and it is shaped for entry into the port 101 through which the elements 121 and 122 protrude for contact with the water in the tank. The element 122 defines a first tube section 122' and a second tube section 122" which are interconnected together at their far end in a spaced-apart manner by a spiral tube section 126 to provide for additional tube length for maximum heat exchange with water within the tank. The tube connecting fittings 125, accessible at the terminal block 123, are adapted for interconnection with a pair of conduits 127 which are provided with couplings 128 with the fittings 125. The far ends of the pair of conduits connect to a remote supply of hot liquid from an alternative thermal fluid supply. This supply can be from heat exchangers such a heat pump connected to a earth energy system where heat from the ground is continuously available and absorbed by a refrigerant gas or any device in which a liquid is circulated to extract heat.

As shown in FIG. 11, the assembly further includes a pump 130 provided with couplings 129 for connection to one of the pair of conduit 127, herein shown connected to conduit 127' but could also be connected to conduit 127". When the pump is placed in operation, hot fluid is caused to flow through the fluid conductive conduit 122 and heat from the hot fluid is exchanged with water in the tank of the water heater. The pump 130 is an electronically controlled pump which is connected to the electronic switching unit 30 through the cut-off switch 48 by leads 130'. When the electronic switching circuit 30 receives a signal from the temperature sensor 32 that a threshold temperature has been attained in the water inside the tank at the location of the sensor 32, the electronic switching circuit trips the cut-off switch 48 causing the pump to shut-down and stopping the flow of hot fluid thought the fluid conductive conduit 122 of the dual element. When the sensed temperature again falls below the set threshold, the pump is started again to heat water within the tank.

Figure 14:
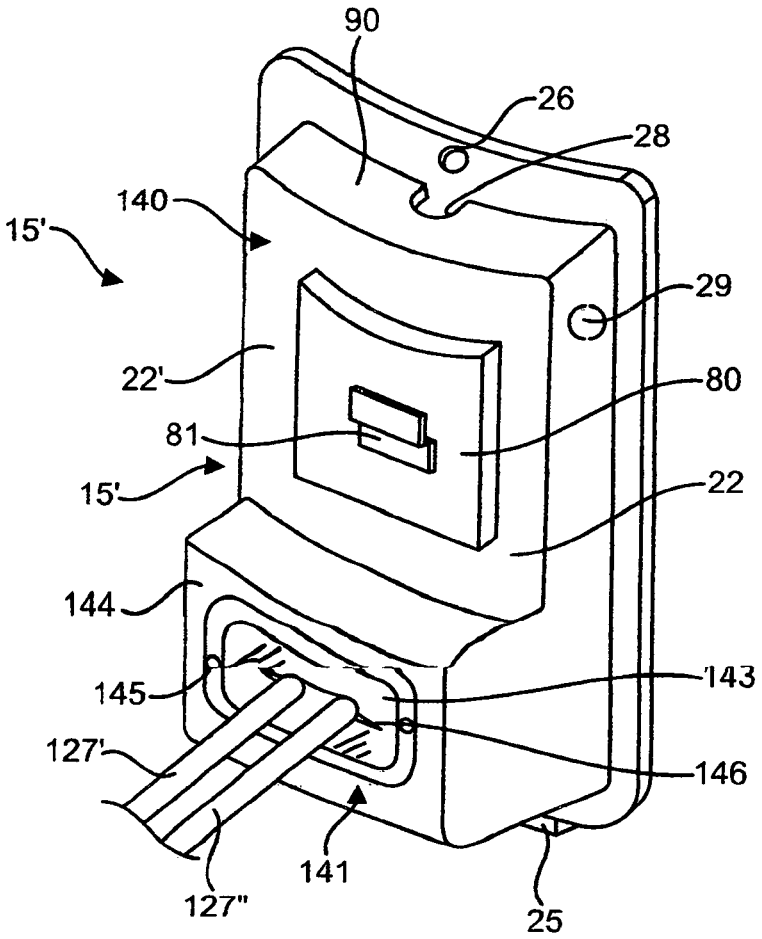
FIG. 14 is a perspective view of the cover plate of the present invention adapted for retrofit with an alternative thermal fluid energy supply.

As shown in FIGS. 11 and 14, the cover plate 15' is herein shown as having two outwardly projecting formations 140 and 141 each defining an internal dedicated compartment and with the bottom compartment 142 being larger whereby to accommodate the conduit couplings and the pump 130. A hose access opening provided with a flexible diaphragm 145 is provided in the projecting front wall 144 of the bottom formation 141 to provide for the entry of the fluid hoses or conduits 127 of the external alternate thermal energy source. The diaphragm is formed of a rubber membrane 143, or other suitable material, having a slit 146 therein for the passage of the conduits 127. An insulating foam material 147 is adhesively secured to the rear surface of the rubber membrane 143, as can be seen in FIG. 11, to insulate the access opening. Once the installation is completed, an insulating wool bat is inserted between the cover plate and the access opening to provide insulation against heat loss.

This further example of the preferred embodiment can be summarize as providing a method of adapting an electrical water heater to an alternative thermal energy source to extract heat from a heated fluid obtained from heat exchange source. With the modified retrofit cover plate and assembly, the existing cover plate secured over the bottom access opening is replaced by the cover plate 15' which can accommodate different components in its assembly. The bottom resistive heating element is replaced with a dual heating element having a replacement resistive heating element and a thermal fluid conductive conduit adapted to receive and conduct a hot fluid there through from the alternative thermal fluid energy supply. Fluid circulating conduits of the alternative thermal fluid energy supply are connected to the thermal fluid conductive conduit of the dual element by fittings of a type known in the art. A pump is secured to one of the conduits from the supply source and located in a dedicated compartment of the cover plate adjacent the bottom access opening of the water heater. The electronic switch unit 30 and its cut-off switch 48 as well as the temperature sensor 32 are mounted as above described with reference to the retrofit assembly of the above described embodiment with respect to the connection to an alternative electrical voltage source. In this embodiment, when the electronic switching circuit receives a signal from the temperature sensor that a threshold temperature of the water in the tank is attained, the cut-off switch is trip causing the pump t stop pumping hot fluid through the fluid conduit of the dual element It is within the ambit of the present invention to cover any obvious modifications of the embodiments described herein above, provided such modifications fall within the scope of the appended claims. As an example of modifications described above, the retrofit assembly also permits an easy conversion of an electrical water heater to operate as a high temperature water heater to increase the capacity of hot water supply by the use of a mixing valve and the result of which reduces the water heater power demand from the grid and a cost saving to the consumer. Also, the electronic switch unit and its sensor will prevent the high limit switch associated with the electric water heater from tripping by controlling the maximum high temperature of the water within the tank, when being heated by an alternative energy supply, and thus avoiding the need for a technician to reset the switch and also avoiding the risk of being deprived of hot water for a prolonged period of time. It is also foreseen that the retrofit cover plate could be made available in different sizes. The retrofit assembly can also be adapted to three or multiple element electric water heaters. Furthermore, the retrofit cover plate and the component assembly can be installed by the water heater manufacturer and made available to alternative energy providers, HVAC businesses. and end users.

The invention claimed is:

1. A multi-functional retrofit cover plate and associated assembly components to adapt an electric water heater for interconnection with an alternative energy system to heat water in a water holding tank of said electric water heater, said retrofit cover plate being adapted for replacement connection over a bottom access opening formed in an outer casing of said electric water heater permitting access to a bottom resistive heating element and an associated thermostat and electrical connections, said retrofit cover plate having an outwardly projecting formation to define an internal dedicated compartment behind said retrofit cover plate, said retrofit cover plate being dimensioned for close retention fit against an outer surface of said outer casing to isolate said bottom access opening, said retrofit cover plate further having one or more access passages to provide access to said internal dedicated compartment from outside said retrofit cover plate, said associated assembly components further including a dual resistive heating element for replacement of said bottom resistive heating element, said dual resistive heating element having a replacement resistive heating element and a dedicated resistive heating element for receiving an alternative supply voltage from said alternative, energy system, said associated assembly components further including an electronic switch unit for connection to a controller of said alternative supply voltage, said electronic switch unit having a normally closed power cut-off switch for connection to said alternative supply voltage and said dedicated resistive heating element of said dual resistive heating element, said associated assembly components also including a temperature sensor for securement against an outer surface of said water holding tank in a lower region of said water holding tank, said temperature sensor feeding one or more temperature signals indicative of water temperature in said lower region of said water holding tank to a programmable electronic switching circuit of said electronic switch unit, said programmable electronic switching circuit operating said normally closed power cut-off switch to an open contact position to cut off said alternative supply voltage upon said water temperature attaining a set programed threshold water temperature.

2. The multi-functional retrofit cover plate and associated assembly components as claimed in claim 1 wherein said outwardly projecting formation is configured to permit connection of a control device of said alternative energy system on an outer surface of said retrofit cover plate.

3. The multi-functional retrofit cover plate and associated assembly components as claimed in claim 2 wherein said outwardly projecting formation has a flat mounting formation in at least a section thereof for mounting said control device thereon.

4. The mufti-functional retrofit cover plate and associated assembly components as claimed in claim 3 wherein said flat mounting formation is a flat surface section of said outwardly projecting formation which slopes at an outward angle from an upper end thereof to a lower end thereof whereby an outer surface of said control device faces at an upward angle for said outer surface to be visible to a person standing and looking down at equipment/module mounted thereon.

5. The multi-functional retrofit cover plate and associated assembly components as claimed in claim 1 wherein said electronic switch unit is secured to an inner surface of said outwardly projecting formation in said internal dedicated compartment, said electronic switch unit having connections for securing said cut-off switch to said alternative supply voltage of said alternative energy system.

6. The multi-functional retrofit cover plate and associated assembly components as claimed in claim 1 wherein said associated assembly components includes a sensor support clamp for mounting said temperature sensor on a sensor support clamp adapted to be supported and held in position by a thermostat support bracket associated with said bottom resistive heating element to place said temperature sensor against an outer surface of said water holding tank to sense water temperature inside said water holding tank at said lower region.

7. The multi-functional retrofit cover plate and associated assembly components as claimed in claim 6 wherein said sensor support clamp is formed from a single flat rectangular metal piece to define a rear wall having a forwardly projecting recess to receive said temperature sensor, and an adjustable fastening element secured to said temperature sensor and an outer wall of said forwardly projecting recess to displace said temperature sensor in said forwardly projecting recess to position said temperature sensor at a desired position with respect to said rear wall to establish contact of said temperature sensor with said outer surface of said water holding tank.

8. The multi-functional retrofit cover plate and associated assembly components as claimed in claim 7 wherein said sensor support clamp further defines opposed forwardly projecting arms, each said forwardly projecting arms having a flat front wall lying in a common plane and having a connecting aperture formed therein to receive a forward bight portion of connecting tabs formed between a pair of connecting arms of said thermostat support bracket for holding said thermostat associated with said bottom resistive heating element.

9. The multi-functional retrofit cover plate and associated assembly components as claimed in claim 1 wherein said temperature sensor is held against said outer surface of said water holding tank by a clamp adapter secured to a mounting base of said dual resistive heating element.

10. The multi-functional retrofit cover plate and associated assembly components as claimed in claim 1 wherein said associated assembly components further includes a cut-off switch state indicating display module secured to an outer surface of said retrofit cover plate to provide a visual display of the state of said cut-off switch.

11. The multi-functional retrofit cover plate and associated assembly components as claimed in claim 10 wherein said cut-off switch state indicating display module is provided by a light to display the on/off state of said cut-off switch and wherein there is further provided a display screen.

12. The multi-functional retrofit cover plate and associated assembly components as claimed in claim 11 wherein said temperature sensor is adapted to feed continuous signals to said electronic switch unit indicative of actual temperature of water in said lower region of said water holding tank, said cut-off switch state indicating display module is adapted to provide a temperature indicating display to provide actual temperature readings of internal water temperatures in said water holding tank at the temperature sensor position.

13. The multi-functional retrofit cover plate and associated assembly components as claimed in claim 1 wherein said dedicated resistive heating element is connected to a battery voltage supply of said alternative energy system, said dedicated resistive heating element having a power rating lower than said replacement resistive heating element and in a range not greater than a maximum of 4000 watts.

14. The multi-functional retrofit cover plate and associated assembly components as claimed in claim 13 wherein said dual resistive heating element is secured to an insulated mounting support assembly for connection to a heating element port of said water holding tank, said resistive heating elements of said dual resistive heating element being secured to said insulated mounting support assembly in a spaced-apart relationship and insulated from one another by said insulated mounting support assembly, said resistive heating elements of said dual resistive heating element having external electrical connectors for receiving a voltage supplied by an AC power supply of said electrical water heater and said alternative supply voltage of said alternative energy system, respectively.

15. The multi-functional retrofit cover plate and associated assembly components as claimed in claim 1 wherein said electronic switch unit has an ac/dc converter for operation of its electronic circuitry, said electronic switch unit having two power input leads connected between two power connection terminals of an ac voltage supply of said electric water heater, a first power input lead being connected to a terminal of a thermistor associated with an upper resistive heating element and a second power input lead connected to a terminal of said bottom resistive heating element, and a storage capacitor for storing a dc supply voltage to drive electronic circuits and to insure the operation of said temperature sensor in the event of a power failure from the grid cutting off said AC supply voltage to said electronic switch unit.

16. The multi-functional retrofit cover plate and associated assembly components as claimed in claim 15 wherein said first power input lead is secured to said electronic switch unit by one of an external lead connection disposed outside said outer casing and an internal lead connection disposed inside said outer casing.

17. The multi-functional retrofit cover plate and associated assembly components as claimed in claim 16 wherein said external lead connection is constituted by a supply lead extending over the outer surface of said outer casing from an upper cover plate to said retrofit cover plate, said supply lead being disposed in a protective cover channel secured to said outer surface of said outer casing.

18. The multi-functional retrofit cover plate and associated assembly components as claimed in claim 16 wherein said internal lead connection is constituted by a supply lead fished through foam insulation disposed between sad outer surface of said water holding tank and an inner surface of said outer casing and extending between an upper access opening associated with said upper resistive heating element and said bottom access opening.

19. The multi-functional retrofit cover plate and associated assembly components as claimed in claim 1 wherein said electrical water heater is provided with a normally closed high temperature limit switch secured to an input voltage supply line of said electrical water heater, said high temperature limit switch is constructed to open to cut-off supply voltage at said input voltage supply line when water temperature in said electrical water heater reaches a predetermined high water temperature threshold value, said electronic switch unit being programmed to maintain water in a bottom region of said water holding tank below said predetermined threshold value as sensed by said temperature sensor, said temperature sensor being secured against an outer surface of said water holding tank in said lower region of said water holding tank, and wherein said assembly further comprises a mixing valve for securement to a hot water outlet pipe connection of said electric water heater, said assembly converting said electric water heater to a high temperature electric water heater.

20. The multi-functional retrofit cover plate and associated assembly components as claimed in claim 19 wherein said predetermined threshold value is set at 170 degrees Fahrenheit, said electronic switch unit receiving temperature signals from said temperature sensor indicative of water temperature inside said water holding tank at the location of said temperature sensor, said electronic switch unit being programmed to cause said power cut-off switch to open when said temperature signals are at a threshold set between 150 to 165 degrees Fahrenheit.

21. A method of retrofitting an electrical water heater to an alternative energy system by a multi-functional cover plate and associated assembly components to heat water in a water holding tank of said electric water heater, said method comprising the steps of:

i) providing a retrofit cover plate for replacing an existing cover plate secured over a bottom access opening formed in an outer casing of said electric water heater permitting access to a bottom resistive heating element and an associated thermostat and electrical connections, said retrofit cover plate having an outwardly projecting formation to define one or more internal dedicated compartments between said retrofit cover plate and an outer surface of said outer casing, ii) replacing said bottom resistive heating element with a dual resistive heating element having one resistive heating element being a dedicated resistive heating element to receive an alternative operating voltage from said alternative energy system, iii) mounting a temperature sensor against an outer surface of said water holding tank to sense water temperature in a bottom region of said water holding tank, iv) mounting a programmable electronic switching circuit having a normally closed power cut-off switch in one of said one or more internal dedicated compartments and establishing power connections thereto, and v) connecting leads of said temperature sensor to said programmable electronic switching circuit to feed one or more sensed water temperature signals to said programmable electronic switching circuit for the monitoring of said temperature signals and for said programmable electronic switching circuit to cause said normally closed power cut-off switch to open and disconnect said alternative operating voltage from said dedicated resistive heating element upon one of said one or more temperature signals attaining a programmed threshold temperature value.

22. The method as claimed in claim 21 wherein there is further provide the step of connecting output voltage leads from a controller of said alternative energy system to supply said alternative supply voltage to said dedicated resistive heating element to heat water in said water holding tank, said alternative supply voltage being derived by one of a voltage supply of said alternative energy system or a battery pack of said alternative energy system.

23. The method as claim in claim 22 wherein there is further provided the step of mounting said controller of said alternative energy system on an outer surface of said outwardly projecting formation of said retrofit cover plate.

24. The method as claimed in claim 21 wherein said step (iii) comprises mounting said temperature sensor on a clamp adaptor and securing said clamp adaptor to a thermistor support bracket to pressure bias said temperature sensor against said outer surface of said water holding tank and establishing communication between said temperature sensor and said programmable electronic switching circuit for the transfer of said one or more water temperature signals.

25. The method as claimed in claim 24 wherein there is further provided the step of mounting a cut-off switch state indicating device on an outer surface of said retrofit cover plate to display the status of said normally closed power cut-off switch.

26. The method as claimed in claim 25 wherein there is further provided the step of feeding said one or more sensed water temperature signals to a controller of said alternative energy system and/or said cut-off switch state indicating device.

27. The method as claimed in claim 21 wherein said step (iv) of establishing power connections to said programmable electronic switching circuit is comprised by connecting a first power input lead from an ac supply terminal from a thermistor of an upper thermistor associated with an upper resistive heating element and a second power input lead from a terminal of said dual resistive heating element associated with said bottom resistive heating element of said electric water heater.

28. The method as claimed in claim 21 wherein there is further provided the step of mounting a mixing valve to a hot water outlet conduit of said water holding tank to convert said electric water heater to a high temperature electric water heater.

* * * * *